US007013497B1

(12) United States Patent
Grant

(10) Patent No.: US 7,013,497 B1
(45) Date of Patent: Mar. 21, 2006

(54) STRAP-SECURING DEVICE

(75) Inventor: Stephen P. Grant, Long Grove, IL (US)

(73) Assignee: Athletic Specialties, Inc., Wauconda, IL (US)

( * ) Notice: Subject to any disclaimer, the term of this patent is extended or adjusted under 35 U.S.C. 154(b) by 686 days.

(21) Appl. No.: 10/098,237

(22) Filed: Mar. 15, 2002

(51) Int. Cl.
*A41D 27/26* (2006.01)

(52) U.S. Cl. ..... 2/459; 2/461

(58) Field of Classification Search ..... 2/2, 2/2.5, 44, 45, 268, 249, 267, 459, 461; 24/168, 24/169, 170, 186, 187, 188, 189, 198, 199, 24/200; D11/200, 212

See application file for complete search history.

(56) References Cited

U.S. PATENT DOCUMENTS

| | | | | |
|---|---|---|---|---|
| 1,150,993 A | * | 8/1915 | Butts | 24/497 |
| 1,271,963 A | * | 7/1918 | Vilandrer | 24/669 |
| 4,080,782 A | | 3/1978 | Colecchio | |
| 4,209,157 A | | 6/1980 | Edmisten | |
| 4,224,722 A | | 9/1980 | Mikosz et al. | |
| 4,292,687 A | | 10/1981 | Daverport, Jr. | |
| 4,382,531 A | | 5/1983 | Bisk et al. | |
| 4,440,334 A | | 4/1984 | Kappel et al. | |
| 4,665,592 A | | 5/1987 | Kasai | |
| 4,793,031 A | * | 12/1988 | Kasai | 24/324 |
| 4,868,954 A | | 9/1989 | Kasai | |
| 5,002,420 A | | 3/1991 | Loyd | |
| 5,029,341 A | | 7/1991 | Wingo, Jr. | |
| 5,060,313 A | | 10/1991 | Neuhalfen | |
| 5,082,155 A | | 1/1992 | Salvador | |
| 5,159,715 A | | 11/1992 | Jurga et al. | |
| 5,187,812 A | | 2/1993 | Neuhalfen | |
| 5,237,704 A | | 8/1993 | Phippen | |
| 5,274,887 A | | 1/1994 | Fudaki | |
| 5,392,553 A | | 2/1995 | Carey | |
| 5,398,339 A | | 3/1995 | Wagner | |
| 5,398,389 A | | 3/1995 | Terada et al. | |
| 5,438,736 A | | 8/1995 | Terada et al. | |
| 5,450,661 A | | 9/1995 | Rekuc | |
| 5,487,187 A | | 1/1996 | Zide et al. | |
| 5,579,538 A | | 12/1996 | Brunty | |
| 5,611,540 A | | 3/1997 | Williams et al. | |
| 5,671,514 A | | 9/1997 | Matoba et al. | |
| 5,722,125 A | | 3/1998 | Vasilopoulos | |
| 5,740,764 A | | 4/1998 | Jacobsen | |
| 5,816,945 A | | 10/1998 | Todd et al. | |
| 5,862,964 A | | 1/1999 | Moliner | |
| 6,000,979 A | | 12/1999 | Stewart | |
| 6,062,449 A | | 5/2000 | Kahn | |
| 6,244,649 B1 | | 6/2001 | Scheck et al. | |
| 6,317,940 B1 | | 11/2001 | Matoba et al. | |

OTHER PUBLICATIONS

Athletic Specialties, Inc. Catalog Dated Oct. 1, 2001, p. 21.
Adams USA, Inc. Catalog Dated: Oct., 2000 pp. 11 and 12.
Riddell Football Catalog Date: 2001 p. 35.
Riddell Football Catalog Date: 2002 p. 30.

* cited by examiner

*Primary Examiner*—Gary L. Welch
(74) *Attorney, Agent, or Firm*—Janson, Shupe & Munger, Ltd.

(57) ABSTRACT

A strap-securing device for use in securing a strap to a shoulder pad worn, for example, on the body of a player in the sport of football. In general, the strap-securing device comprises a strap-engagement member and a catch member joined together by a linkage permitting the members to swivel with respect to each other. The strap-engagement member is secured to a strap free end. The catch member of the strap-securing device is secured to the shoulder pad chest plate. The secured straps firmly hold the shoulder pad in place on the wearer's body. The strap-securing device advantageously provides a secure strap attachment point, without strap slippage, while simultaneously permitting elongation or shortening of the strap length. The swiveling action of the strap-securing device permits the device to lie flat against the shoulder pad while bending and straightening in concert with the wearer's movement.

20 Claims, 3 Drawing Sheets

STRAP-SECURING DEVICE

FIELD OF THE INVENTION

This invention is related generally to securing devices and, more specifically, to strap-securing devices for use with football shoulder pads and other types of athletic equipment.

BACKGROUND OF THE INVENTION

Shoulder pads for use in the game of football typically include a pair of padded rigid arches or arch portions each terminating in the front with a chest plate and in the rear with a back plate. The front chest plates are typically connected with laces while the back plates are connected by straps extending between the back plates. Right and left shoulder protective epaulets are commonly secured to the top surface of a respective arch and padding is secured to the arch bottom surfaces to cushion the shoulder pad against the wearer's shoulder.

Two underarm straps are typically provided to further secure the shoulder pad to the wearer's body. The straps are commonly made of elastic webbing or a combination of elastic and non-elastic webbing. The straps are typically between about 1.5–2 inches in width. Each strap has one end secured to a respective back plate by a connector, such as a rivet. The other end of the strap is attached to the chest plate by a securing device described in more detail below. The shoulder pad is secured to the wearer's body by leading the straps under the wearer's arms and securing the second end to a respective chest plate. Tightening of the elastic strap secures the shoulder pad in place on the wearer's body.

The strap second end is typically attached to the respective chest plate by a securing device in the form of a hook or a slide device. In the trade, the hook devices are referred to as "T-hooks" while the slide devices are referred to as "keyhole" slides. The assignee of the application, Athletic Specialties, Inc. of Waucanda, Ill., has supplied these types of strap-securing devices to universities, high school athletic departments and other customers for many years. Representative examples of such devices are shown in FIGS. 2–4.

Keyhole-style strap-securing devices have a one-piece, unitary body which includes a slotted strap-engagement portion and a keyhole slide portion. The strap second end is led through the slots thereby securing the strap to the device. The keyhole slide portion is mated with a corresponding pin on the chest plate to secure the strap under the wearer's arm.

T-hook style strap-securing devices are available in two configurations. In one such configuration, the T-hook is made of a one-piece body with a slotted strap-engagement portion and a rigid T-shaped hook portion connected to the strap-engagement portion by an elongate rigid neck. The strap second end is led through the slots and is secured to the device as with the keyhole-type securing device. The T-shaped hook is then mated with a corresponding slot in the chest plate.

The second type of T-hook configuration comprises a strap-engagement member in the form of a "corset-style" catch and a swiveling T-shaped hook. The strap-engagement member of this type of T-hook consists of a D-shaped ring with a fixed jaw element and an opposed movable jaw element. The movable jaw element is loosely crimped at each end along opposed sides of the D-shaped ring permitting movement toward and away from the fixed jaw element. The strap second end is led behind the movable jaw element and then back between both jaw elements whereupon it is intended that the jaw elements clamp the strap in place. The T-shaped hook is then mated with a corresponding slot in the chest plate.

While these conventional securing devices are completely suitable for certain applications, they are not without potential limitations. For example, movement of the corset-style T-hook during use tends to loosen the grip of the movable jaw element causing the elastic strap to slip from the securing device. The wearer must periodically adjust the strap to compensate for the slippage in order to maintain proper fit of the shoulder pad. If the slippage is substantial, the strap may become completely desecured from the hook. Such desecuring disadvantageously requires that the wearer discontinue play while the shoulder pad strap is readjusted. Moreover, any desecuring of the strap-securing device can result in loss of such device rendering the shoulder pad unusable.

Typically, the wearer will attempt to prevent strap slippage by wrapping adhesive tape around the jaw elements to hold the jaw elements and strap in place. However, this is extremely disadvantageous because it prevents any adjustment of the strap length. As a result, the strap cannot be tightened should the strap become stretched and elongated after use and the strap cannot be lengthened if the wearer wishes to wear additional clothing, for example, additional layers of garments for playing the sport in cold weather conditions. When the shoulder pad is cleaned or reconditioned, the tape must be manually removed. This can be a laborious and time intensive process particularly where an entire team's collection of shoulder pads is being cleaned or refurbished.

Strap-securing devices with movable jaw elements involve potentially unnecessary manufacturing steps increasing the costs of such components. Separate bending steps are required to secure the movable jaw element to the D-shaped element. Moreover, the swiveling hook portion of such devices may consist of a single piece of metal folded back onto itself and welded together. Plural manufacturing steps are required to fabricate such devices and, of course, any additional manufacturing steps can increase the cost to manufacture the strap-securing device.

The strap-securing devices with one-piece body construction are limited in that they do not bend and straighten to conform to the movements of the wearer. Consequently, such devices could become disengaged from the respective slot or mating post during extreme wearer movements.

Further, stresses applied to the narrow neck portion of the T-shaped hooks with unitary bodies during extreme use could cause the device to break and fail. Any failure of the strap-securing device may result in the wearer having to withdraw from the game so that the shoulder pad or other equipment can be adjusted.

While not likely, it is possible for the rigid neck portions of the T-shaped hooks to become inserted into the slot on the shoulder pad chest pad in such a way that the device protrudes outwardly from the slot rather than lying flat against the chest plate. Any such protrusion could catch on the wearer's jersey, potentially tearing the jersey.

It would be a significant improvement in the art to provide an improved strap-securing device for securing a strap to a shoulder pad or the like which would provide a more secure connection between the shoulder pad straps and the shoulder pad, which would accommodate the wearer's movement and remain in place during extreme movement, which would lie flat on the wearer's chest plate and which would be sturdy and economical to manufacture.

OBJECTS OF THE INVENTION

It is an object of this invention to provide an improved strap-securing device overcoming problems and shortcomings of the prior art.

Another object of this invention is to provide an improved strap-securing device which would provide a more secure connection between a strap and a shoulder pad or other device worn on the body;

An additional object of this invention is to provide an improved strap-securing device which would accommodate the wearer's movement;

It is also an object of this invention to provide an improved strap-securing device which would remain in place during extreme wearer movement;

A further object of this invention is to provide an improved strap-securing device which would lie flat on the wearer's chest plate Yet another object is to provide an improved strap-securing device which is sturdy and economical to manufacture.

How these and other objects are accomplished will be apparent from the descriptions of this invention which follow.

SUMMARY OF THE INVENTION

The present invention is an improved strap-securing device, particularly for use in securing a shoulder pad protective device to a wearer's body. The shoulder pad typically includes two underarm straps provided to secure the shoulder pad to the wearer's shoulders. Each strap has both a free end and a second end secured to a rear shoulder pad plate. Each strap free end is attached to a respective strap-securing device. Each strap is pulled snug under the wearer's arm and each strap-securing device is attached to the appropriate shoulder pad chest plate firmly securing the shoulder pad to the wearer's shoulders. The inventive strap-securing device provides important advantages over strap-securing devices of the prior art as will be apparent from the disclosure which follows.

In general, the strap-securing device comprises a strap-engagement member and a catch member. The strap-engagement member is joined to the catch member by a swivelling linkage which permits each such member to move with respect to the other.

The preferred strap-engagement member includes first and second ends, side elements and a pair of non-moving posts defining first, second and third elongate slots through the member. Preferably, each of said slots has a slot axis and each slot is positioned in the member, one next to the other, such that the slot axes are substantially parallel one to the other.

In highly preferred forms of the invention, the strap-engagement member has a top surface and a bottom surface and the strap-engagement member defined by said surfaces is substantially flat. Preferably, each slot has a length and a width dimension. For reasons which will become apparent, each slot width dimension is preferably substantially the same while the length dimension of the second slot is equal to or less than length dimensions of the first and third slots.

The preferred slots are provided to receive the strap inserted therethrough and around the posts. The slots advantageously provide a secure attachment point without slippage yet also permit the strap length to be elongated or shortened.

The preferred catch member includes first and second ends. The first end is movably joined to the strap-engagement second end by a mechanical linkage. Most preferably, the catch member first end is positioned through the strap-engagement member third slot and loosely around the strap-engagement member second end. In the most highly preferred form of the invention, the catch member first end has a width dimension less than the width dimension of the third slot and a thickness dimension less than the length dimension of the third slot and the catch hook member first end is positioned entirely through the third slot. In this embodiment, the catch member first end takes the form of an eyelet linkage joining the strap-engagement and catch members and permitting swiveling movement of each member with respect to the other.

Other types of mechanical linkages may be provided to join the strap-engagement and catch members. For example, a pair of opposed coaxial male pins may be provided on the catch member to movably mate with corresponding female openings provided on the strap-engagement member. The swiveling linkage advantageously permits the strap-engagement and catch portions to move with respect to the other allowing the device to lie flat against the chest plate during strenuous use.

The preferred catch member second end includes a catch element formed integrally in the catch member second end. The catch element is configured to mate with a corresponding mount on the shoulder pad chest plate, for example a mount consisting of a slot or a flanged male pin.

The catch element is most preferably a hook and this most highly preferred form of the invention may be characterized as a swivel hook. The most highly preferred form of hook element comprises a "T-shaped" hook element. The preferred T-shaped hook element is joined to the catch member through a neck portion. It is most highly preferred that the catch member has a top side and a bottom side and that the hook element is offset from the catch member second end with the neck portion extending away from the bottom side at an angle of less than 90° and preferably about 45°. Other types of catches, such as keyhole slides configured to mate with a male post on the chest plate may be used.

Most preferably, the strap-engagement member and catch member are each unitary members.

The strap-securing device of the invention may be made of any suitable material. Metal is most preferred but other materials, such as plastic may be used. Cold rolled 1018 or 1020 carbon steel is a highly preferred material. The steel may be hardened or treated as desired to impart appropriate properties.

The strap-securing device of the invention is not limited to use with a football shoulder pad and may be used to secure the straps of other athletic products or devices worn in conjunction with the wearer's body.

The inventive strap-securing device provides important advantages not found in prior art devices. The slotted strap-engagement member provides a non-slip strap attachment point which completely avoids the slippage associated with the corset-style T-hook including the movable jaw element. Such non-slip attachment ensures that the shoulder pad will not loosen during use with the resultant benefit that the athlete will not have to leave the game for adjustment of the shoulder pad. Advantageously, this result is achieved without any necessity to use adhesive tape to hold the strap in place on the strap-securing device.

The flexible connection between the strap-engagement and catch members permits the strap-securing device to lie flat against the shoulder pad chest plate and allows the strap-securing device to move in concert with the wearer's movement. Advantageously, this structure avoids protrusions which could damage the wearer's jersey and avoids unwanted disconnection of the strap-securing device from the shoulder pad.

The simple construction of the strap-securing device requires a minimal number of parts and the parts which are required are sturdy and not prone to failure. Fewer manufacturing steps are required versus corset-style hooks of the prior art reducing costs while providing a superior product.

It should be pointed out that, while the present invention represents an improvement in the strap-securing art, neither this device, nor any other device, can remove the risk of injury for those who participate in inherently hazardous activities such as football and the like. Further, no device can prevent the risk of injury when such devices are used in a manner contrary to the rules of the sport or other endeavor, for example to spear or ram an opposing player, person or object. The shoulder pad and securing straps must always be used in an appropriate manner and in accordance with all rules and guidelines.

The examples shown in these figures and described herein are intended to be illustrative only and not limiting with respect to the scope of the invention.

DETAILED DESCRIPTION

Figure 1:
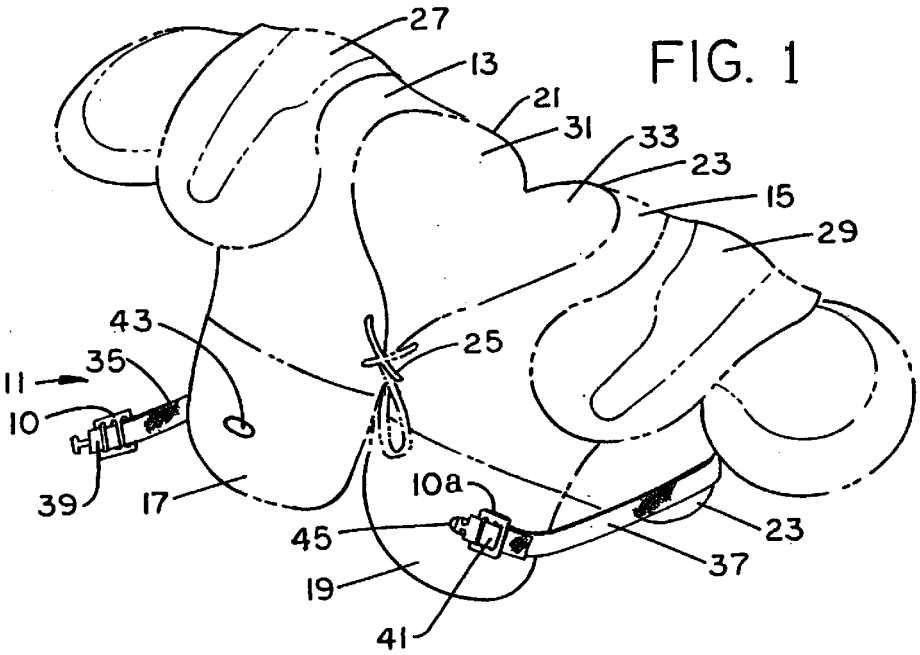
FIG. 1 is a perspective view of two exemplary strap-securing devices according to the invention shown in conjunction with an exemplary shoulder pad of the type used in the sport of football.

Referring first to FIG. 1, that figure illustrates exemplary strap-securing devices 10, 10*a* according to the invention shown in conjunction with a shoulder pad 11 of the type worn on the shoulders of an athlete in the game of football. Shoulder pad 11 includes a pair of padded rigid arches 13, 15 terminating in the front with a chest plate 17, 19 and in the rear with a pair of back plates 21, 23. Laces 25 are provided to join the chest plates 17, 19 and secure the shoulder pad on the wearer's chest. Right and left protective shoulder epaulets 27, 29 are secured along the top surface of a respective arch 13, 15. Padding (not shown) is secured to the arch bottom surfaces 31, 33 to cushion the shoulder pad 11 against the wearer's shoulder.

Underarm straps 35, 37 are provided to further secure shoulder pad 11 to the wearer's body. Straps 35, 37 are preferably made of elastic webbing and may be of any suitable width with a width of approximately 1.5 to 2 inches being typical. Each strap 35, 37 is secured at one end to a respective back plate 21, 23 by a rivet (not shown) or other suitable connector. The other strap end 39, 41 is removably secured to the respective chest plate 17, 19 by a respective strap-securing device 10, 10*a* secured to a respective shoulder pad mount, preferably in the form of slots 43, 45. The length of each strap 35, 37 can be adjusted as described more fully below. The elastic properties of straps 35, 37 provide a snug fit holding shoulder pad 11 in place on the wearer's shoulders.

Figure 2:
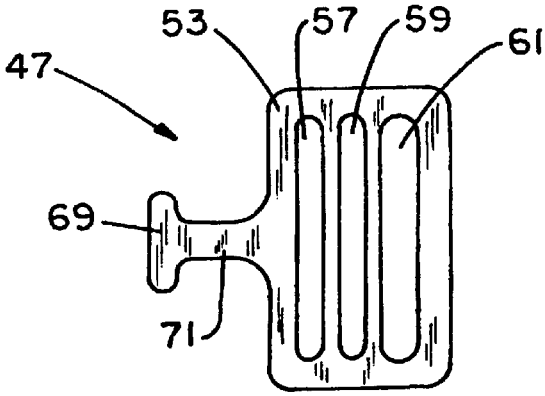
FIG. 2 PRIOR ART
FIGS. 2–4 are each perspective views of prior art strap-securing devices.
Figure 3:
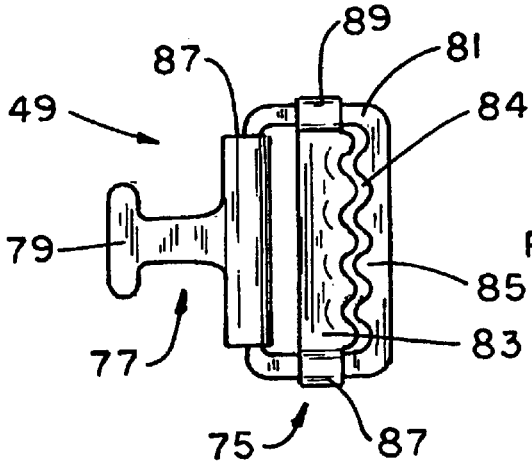
FIG. 3 PRIOR ART
Figure 4:
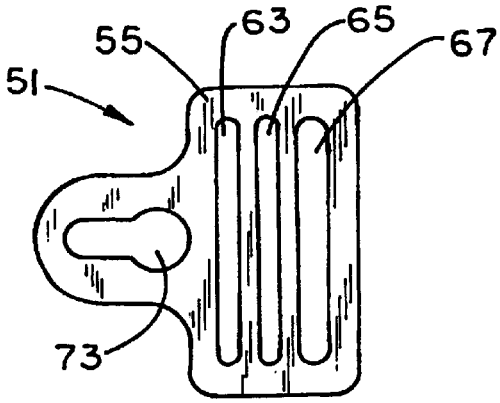
FIG. 4 PRIOR ART

In order to best understand the improvements provided by the inventive strap-securing device 10, it will be useful to describe the strap-securing devices 47, 49 and 51 of the prior art shown in FIGS. 2–4. Such devices are and have been commercially available from Athletic Specialties, Inc. since at least 1976.

Device 47 (FIG. 2) is a "T-hook" style strap-securing device and device 51 (FIG. 4) is a "keyhole" style device. Each device 47, 51 has a one-piece body 53, 55 with three slots 57–61, 63–67 provided to receive a strap, such a strap 35, 37. Device 47 has a rigid T-shaped hook portion 69. The hook portion 69 is connected to body 53 by an elongate rigid neck 71 and is configured for insertion into a slot, such as slot 43 or 45. Device 51 has a keyhole 73 which mates with a flanged pin (not shown) on a respective shoulder pad chest plate 17, 19.

The rigid construction of devices 47, 51 prevents the devices from bending and straightening as the wearer moves making it possible for the devices 47,51 to potentially disengage from the respective slot 43, 45 or mating post during extreme wearer movement. In addition, it is possible that the rigid narrow neck portion 71 of device 47 could fail under conditions of extreme use or the hook 69 and neck 71 could become seated in the slot 43, 45 so that the device 47 would protrude and not lie flat against a respective chest plate 17, 19. In either case, adjustment of the shoulder pad 11 may be required, potentially resulting in withdrawal of the player from the game.

Device 49 (FIG. 3) is an example of a T-hook style device including a "corset-style"strap-engagement member 75 and a movably mounted T-shaped hook portion 77. T-shaped hook 79 is provided to mate with a corresponding slot 43 or 45 in the chest plate. The strap-engagement portion 75 includes a D-shaped ring 81 with opposed fixed and movable jaw elements 83, 85. The movable jaw element 83 is loosely crimped at each end 87, 89 along opposed sides of the D-shaped ring 81 permitting movement toward and away from the fixed jaw element 83. The strap 35 or 37 end is led through opening 84 and down between jaw strap therebetween.

A disadvantage of the corset-style strap-engagement member 75 is that the movable jaw element 83 can move away from element 81 thereby loosening the grip of the jaw elements 81, 83 on the strap 35 or 37. To prevent any such slippage, a wearer will wrap adhesive tape around the ring element 81 and strap 35 or 37. This arrangement is unsatisfactory because the strap length cannot be adjusted and the tape must be cut away in order to recondition the shoulder pad 11.

Figure 5:
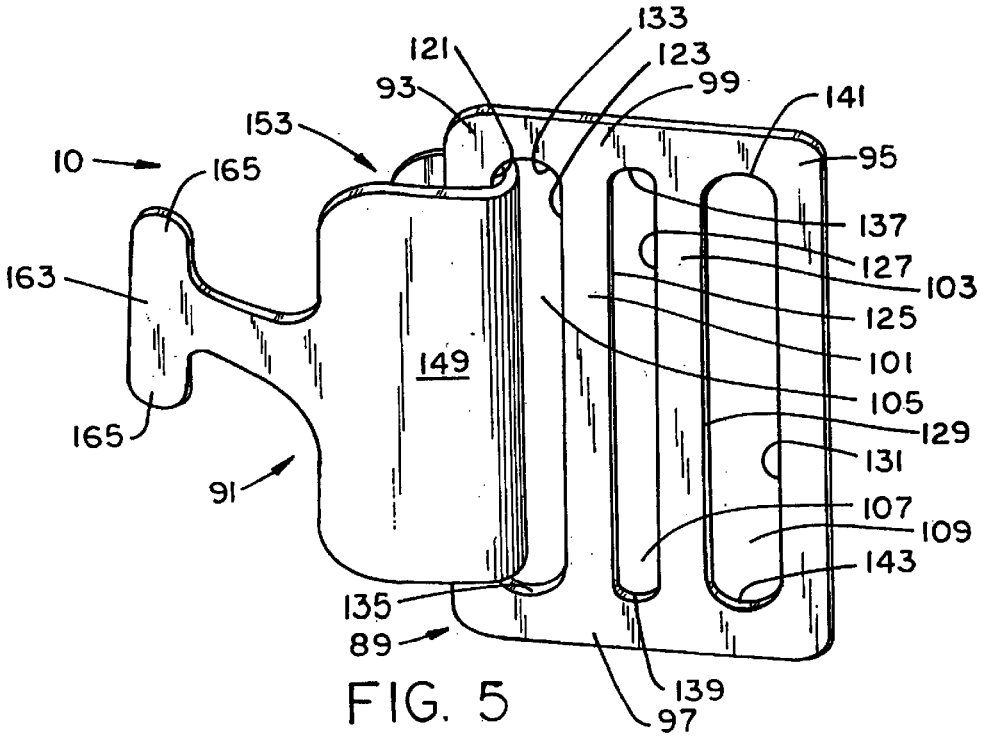
FIG. 5 is a perspective view of an exemplary strap-securing device according to the invention.
Figure 6:
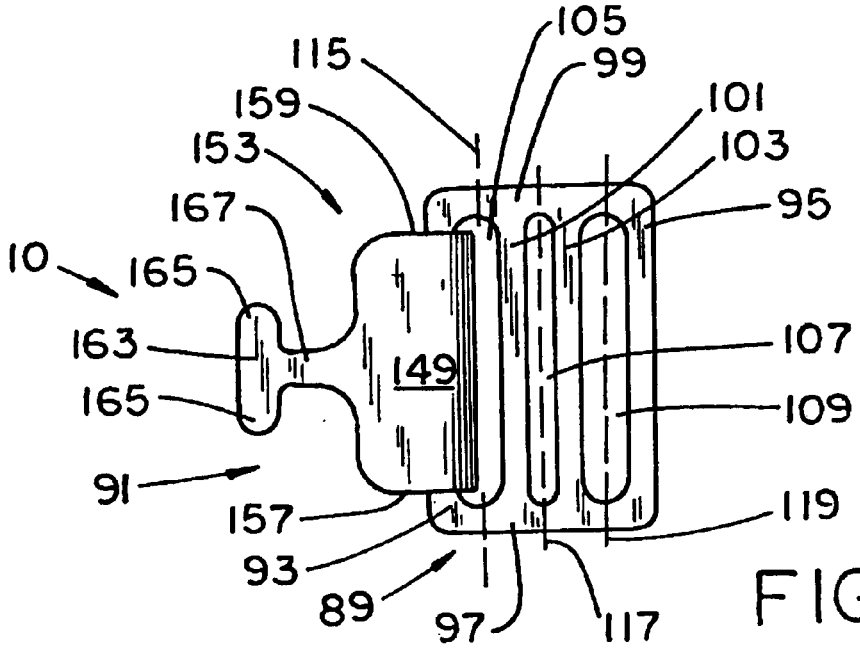
FIG. 6 is a top view of an exemplary strap-securing device according to the invention.
Figure 7:
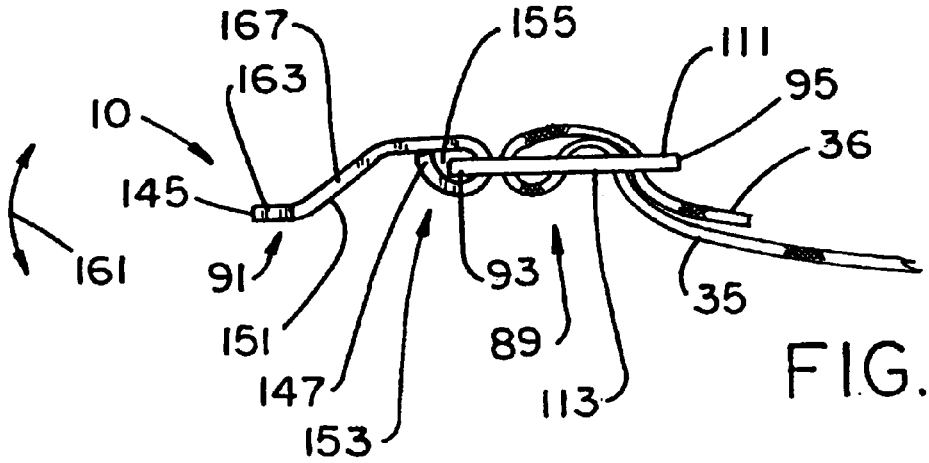
FIG. 7 is a side elevation view of an exemplary strap-securing device according to the invention showing an exemplary strap portion led through the strap-securing device.

Referring now to FIGS. 5–7, those figures illustrate an exemplary strap-securing device 10 in the form a swivel hook. The exemplary strap-securing device 10 includes a strap-engagement member 89 and a catch member 91. The strap-engagement member 89 is provided with first and second ends 93, 95, side elements 97, 99, a pair of non-moving posts 101, 103 defining first, second and third elongate slots 105–109 and top and bottom surfaces 111, 113. Preferably, and as shown in FIG. 6, each of slots 105–109 has a respective slot axis 115–119 each of which is parallel to the other.

As shown in FIGS. 5 and 6, the structure of slots 105–109 may differ in order to facilitate secure attachment of strap 35 to member 89. For instance, each slot 105–109 has a length dimension between respective slot edges 121–131 and a width dimension between slot end edges 133–143. The width dimension of each slot 105–109 is preferably the same while the length dimension of each slot 105, 109 is preferably greater than the length dimension of slot 107. As shown in FIG. 7, the greater length dimension of slot 109 facilitates insertion of strap 35 twice through slot 109. The greater length dimension of slot 105 accommodates both strap 35 and catch member 91 positioned through slot 105.

It is preferred that the slot edges 133–143 are smoothed or rounded, providing a "race-track" appearance as shown in FIGS. 6 and 7. Such rounding avoids sharp edges which can fray and damage strap 35 inserted through slots 105–109. Other slot 105–109 configurations, orientations and length and width dimensions may be used in accordance with the invention. It is not required that engagement member 89 include three slots as other numbers of slots may be provided consistent with the invention.

The preferred arrangement of slots 105–109 in member 89 provides a secure attachment point for strap 35 while at the same time permitting adjustment of the length of strap 35. The preferred mode of strap attachment is well-shown in FIG. 7. As shown, strap 35 is led along a serpentine path from bottom surface 111 through slot 109, over post 103, through slot 107, under post 101, through slot 105 and back across top surface 111 down through slot 109. The strap 35 is locked in place when in the configuration shown in FIG. 7. At the same time, the strap 35 can be loosened for strap length adjustment merely by pushing the leading end 36 of strap 35 back through slot 109 and sliding the strap 35 through member 89 in the desired direction to shorten or lengthen the strap 35.

Strap-engagement member 89 is preferably substantially flat and is made from a single piece of material. For example, member 89 may be stamped in a single operation from a piece of cold rolled 1018, 1020 or 1045 carbon steel. Other materials, such as brass or stainless steel, could be utilized.

Referring further to FIGS. 5–7, the preferred catch member 91 has first and second ends 145, 147 and top and bottom surfaces 149, 151. A linkage 153 movably joins catch member 91 to strap-engagement member 89. Specifically, end 147 is positioned through slot 105 and is formed by a press to provide an eyelet 155 linkage which is positioned loosely about end 93 (FIG. 7). As shown in FIGS. 5 and 6, catch member 91 end 147 has a width dimension between edge surfaces 157, 159 which is less than the width of slot 105 and a thickness dimension between top and bottom surfaces 149, 151 which is less than the length of slot 105. This preferred arrangement permits swiveling movement of the strap-engagement and catch members 89, 91 with respect to the other in the directions represented by the two-headed arrow 161 of FIG. 7. Such single step forming process is more efficient than the process used to manufacture conventional hooks.

Catch member end 145 includes a catch 163, preferably in the form of the T-shaped hook element with tangs 165 and an elongate neck portion 167 shown in FIGS. 1 and 5–7. The catch 163 is configured to be inserted into a corresponding shoulder pad mount, such as elongate slot 43 in shoulder pad chest plate 17. The catch 163 is then rotated approximately 90° so that the tangs 165 engage corresponding slot surfaces inside the shoulder pad chest plate (not shown) to hold catch 163 in place on the chest plate 17. As shown in FIG. 7, neck portion 167 is preferably formed so that it extends away from top surface 149 at an angle of less than about 90°, and most preferably about 45°. As a result, catch member end 145 is offset from end 147 to permit catch 163 to be inserted into the slot 43. It is envisioned that types of catches 163, other than T-shaped hooks, may be used in connection with the strap-securing device 10. For example, it is possible that a keyhole slide element could be used to mate with a flanged male post on the chest plate 19 or a hook having a design other than a T-shaped hook could be used in accordance with the invention.

Catch member 91 may be stamped in a single operation from a piece of cold rolled 1018, 1020 or 1045 carbon steel and is preferably made from the same material as member 89. Members 89 and 91 may be deburred or tumbled to remove rough surfaces and such components may be hardened or otherwise treated as appropriate. Optionally, members 89, 91 may be coated with resin, nylon or any other suitable material to impart desired properties such as rust resistance or color.

In use, the novel strap-securing device 10 is first secured to strap 35 by engagement of strap 35 with strap-engagement member 89. Strap 35 is led through slots 105–109 and between posts 101, 103 and is adjusted to an appropriate strap length. Strap-securing device 10 is then grasped and the strap 35 pulled so that the catch 163 is in position to engage the corresponding shoulder pad chest plate mating structure, such as slot 43. Catch is then engaged with slot 43. The elastic properties of strap 35 securely hold shoulder pad 11 in place on the wearer's shoulders.

The principles of this invention have been described in connection with specific embodiments. It should be understood clearly that these descriptions are made only by way of example not intended to limit the scope of the invention.

What is claimed is:

1. A strap-securing device for attaching an underarm strap to a shoulder pad, comprising:

a strap-engagement member for attachment to the strap, said member having first and second ends, side elements and a pair of non-moving posts defining first, second and third elongate slots through the member, each of said slots having a slot axis and being positioned in the member one next to the other with the slot axes substantially parallel, said slots being provided to receive the strap inserted therethrough and around the posts; and a catch member for attachment to a shoulder pad mount, said member having first and second ends, the first end being positioned through the third slot and loosely around the strap-engagement member second end to form an eyelet linking the strap-engagement member and catch member and permitting swiveling movement of each member with respect to the other, the second end having a catch element configured for engagement with the shoulder pad mount.

2. The strap-securing device of claim 1 wherein the strap-engagement member and catch member are each unitary members.

3. The strap-securing device of claim 1 wherein the strap-engagement member has a top surface and a bottom surface and the strap-engagement member defined by said surfaces is substantially flat.

4. The strap-securing device of claim 1 wherein each slot has a length and a width dimension, and (a) each slot width dimension is substantially the same and (b) the second slot length dimension is equal to or less than the first and third slot length dimensions.

5. The strap-securing device of claim 1 wherein the third slot has a length and a width dimension, the catch member first end has a width dimension less than the third slot width and a thickness dimension less than the third slot length and the catch member first end is positioned entirely through the third slot.

6. The strap-securing device of claim 1 wherein the catch member catch element comprises a hook element formed integrally in the catch member second end.

7. The strap-securing device of claim 6 wherein the catch member hook element comprises a T-shaped hook element and further includes a neck connecting the T-shaped element to the catch member.

8. The strap-securing device of claim 7 wherein the catch member has a top side and a bottom side and the neck extends away from the bottom side at an angle of less than 90°.

9. The strap-securing device of claim 1 wherein the strap-engagement engagement member and catch members are made of cold rolled steel sheet.

10. A strap-securing device for attaching a strap to a protective athletic pad, comprising:

a strap-engagement member for attachment to a strap, said member having first and second ends, side elements and non-moving posts defining plural elongate slots through the member, each of said slots having a slot axis and being positioned in the member one next to the other with the slot axes substantially parallel, said slots being provided to receive the strap inserted therethrough and around the posts; and a catch member for mating engagement with a corresponding athletic pad mount, said catch member having first and second ends, the second end having a catch configured for engagement with the mount; and a swiveling linkage directly joining the catch member to the strap-engagement member and configured to permit swiveling movement of each member with respect to the other.

11. The strap-securing device of claim 10 wherein the strap-engagement member and catch member are each unitary members.

12. The strap-securing device of claim 10 wherein the strap-engagement member has a top surface and a bottom surface and the strap-engagement member defined by said surfaces is substantially flat.

13. The strap-securing device of claim 10 wherein the non-moving posts comprise a pair of posts and the first and second ends, side elements and non-moving posts define first, second and third elongate slots through the member.

14. The strap-securing device of claim 13 wherein each slot has a length and a width dimension, and (a) each slot width dimension is substantially the same and (b) the second slot length dimension is equal to or less than the first and third slot length dimensions.

15. The strap-securing device of claim 10 wherein the linkage comprises the catch member first end positioned through the slot adjacent the strap engagement member second end and loosely around the strap-engagement member second end to form an eyelet linking the strap-engagement member and catch member and permitting swiveling movement of each member with respect to the other.

16. The strap-securing device of claim 15 wherein the slot through which the catch member first end is positioned has a length and a width dimension, the catch member first end has a width dimension less than said slot width and a thickness dimension less than said slot length and the catch member first end is positioned entirely through said slot.

17. The strap-securing device of claim 16 wherein catch member catch comprises a hook element formed integrally in the catch member second end.

18. The strap-securing device of claim 17 wherein the catch member hook element comprises a T-shaped hook element and further includes a neck connecting the T-shaped element to the catch member.

19. The strap-securing device of claim 18 wherein the catch member has a top side and a bottom side and the neck extends away from the bottom side at an angle less than about 90°.

20. The strap-securing device of claim 10 wherein the strap-engagement member and catch members are made of cold rolled steel sheet.

* * * * *

UNITED STATES PATENT AND TRADEMARK OFFICE

CERTIFICATE OF CORRECTION

PATENT NO. : 7,013,497 B1
APPLICATION NO. : 10/098237
DATED : March 21, 2006
INVENTOR(S) : Grant It is certified that error appears in the above-identified patent and that said Letters Patent is hereby corrected as shown below:

In column 3, lines 9, 12 and 15, delete each occurrence of ":" and insert --.-- In place thereof.

In column 3, line 18, after "body" insert --.--.

In column 6, after line 54, insert the following paragraph:
--Device 49 is complex to manufacture requiring crimping of the movable jaw element 83 to the D-shaped ring 81. The T-shaped hook portion 77 is a single piece of metal folded back onto itself in a separate bending step to form eyelet 87. Separate welds (not shown) are required to join together the folded portions forming part 77 together.--

To claim 9, at column 9, line 19, after "strap-engagement" delete "engagement member".

To claim 17, at column 10, line 28, after "claim 16 wherein" insert --the--.

To claim 20, at column 10, line 40, after "strap-engagement" delete “member”.

Signed and Sealed this

Twenty-sixth Day of December, 2006

JON W. DUDAS
*Director of the United States Patent and Trademark Office*